US005267003A

United States Patent [19]

Grappiolo

[11] Patent Number: 5,267,003

[45] Date of Patent: Nov. 30, 1993

[54] TONER CARTRIDGE REFILLING SEAL USING MAGNETIC MATERIAL

[75] Inventor: Giancarlo Grappiolo, Middletown, Pa.

[73] Assignee: Olivetti Supplies, Inc., Middletown, Pa.

[21] Appl. No.: 928,067

[22] Filed: Aug. 11, 1992

[51] Int. Cl.[5] ..... G03G 15/06

[52] U.S. Cl. ..... 355/260; 141/364; 141/DIG. 1; 355/200

[58] Field of Search ..... 355/260, 200, 202, 210; 141/DIG. 1, 366, 367, 368; 222/DIG. 1

[56] References Cited

U.S. PATENT DOCUMENTS

| | | | |
|---|---|---|---|
| 3,788,275 | 1/1974 | Hanson . | |
| 3,906,899 | 9/1975 | Harpauat | 118/655 |
| 3,974,944 | 8/1976 | Takeuchi . | |
| 4,213,617 | 7/1980 | Salger . | |
| 4,373,468 | 2/1983 | Suda et al. | 355/260 X |
| 4,732,277 | 3/1988 | Smith . | |
| 4,816,877 | 3/1989 | Keen | 222/DIG. 1 |
| 4,862,210 | 8/1989 | Wooley | 355/260 X |
| 4,913,448 | 4/1990 | Bhagwat et al. . | |
| 4,924,920 | 5/1990 | Bhagwat . | |
| 4,930,684 | 6/1990 | Patterson . | |
| 5,031,004 | 7/1991 | Borostyan | 355/245 X |
| 5,079,590 | 1/1992 | DeCecca . | |
| 5,080,745 | 1/1992 | Paull . | |
| 5,109,720 | 5/1992 | Kasuga . | |
| 5,110,646 | 5/1992 | Prestel et al. . | |
| 5,111,976 | 5/1992 | Ban | 222/DIG. 1 |
| 5,177,536 | 1/1993 | Watanabe et al. | 355/215 X |

FOREIGN PATENT DOCUMENTS

| | | |
|---|---|---|
| 0120819 | 9/1981 | Japan . |
| 0170869 | 9/1984 | Japan . |
| 0028673 | 2/1985 | Japan . |
| 00172173 | 8/1986 | Japan . |

*Primary Examiner*—A. T. Grimley
*Assistant Examiner*—Matthew S. Smith
*Attorney, Agent, or Firm*—Stevens, Davis, Miller & Mosher

[57] ABSTRACT

A cartridge for holding toner powder has an exit opening with a surrounding flange. When a cartridge is refilled for re-use the exit opening is closed by a sliding cover. In order to minimize the leakage of toner powder around the cover, a magnetic strip is secured on the flange surrounding the cover so that leaking powder will be attracted to the magnet.

2 Claims, 1 Drawing Sheet

TONER CARTRIDGE REFILLING SEAL USING MAGNETIC MATERIAL

The present invention relates to a refillable toner cartridge. Specifically, the present invention relates to such a cartridge with a magnetic strip to avoid leakage of toner powder during shipment and handling after re-filling and prior to re-use.

BACKGROUND OF THE INVENTION

Laser printers and xerographic copiers employ a dry powder toner to produce the copied image. To assist in the production of such images, the toner powder is usually magnetic. Recently, production has turned to the development of reusable toner cartridges, which can be refilled with new toner powder and the cartridge reinserted into a printer. The refilling of toner powder in a cartridge has a critical point relative to the removable cover of the body which contains the toner to prevent the toner powder from leaking along the sides of the removable cover. Due to the extremely messy nature of toner, it is desirable to prevent or avoid as much of this leakage as possible.

The recycling of used toner cartridges requires two basic steps: the insertion of a removable cover over the exit opening of an empty cartridge; and the filling of the empty cartridge body with new toner powder. Since the filling takes place while the cartridge is assembled, the insertion of the removable cover is performed without any possibility to verify that the surfaces which the cover enclose are completely clean, ensuring a tight seal. In the manufacture of new toner cartridges, the original seal for the toner reservoir usually comprises a thin vinyl strip of plastic that is heat fused on a seal plate which extends around the perimeter of the toner reservoir prior to the operative connection of a roller housing to the reservoir housing. Then the reservoir housing is heat welded to the roller housing and these housings for all practical purposes become one unit in which the seal plate is disposed intermediate the juncture of the roller housing and the reservoir housing.

When the new cartridge is ready to be used by the customer, the original toner reservoir seal is manually removed, thereby exposing a peripheral recess that had been created between the reservoir housing the roller housing to accommodate the original removable cover. This peripheral recess or cavity as will be explained later in greater detail becomes crucial to the recharging and sealing aspects of the present invention. Obviously once the original reservoir seal has been removed there is nothing to prevent the toner from getting into the remainder of the cartridge system; and, thus a replacement sealing means must be employed in order to enable the toner cartridge to be recharged with toner and thereby be suitable for recycling.

There have been various prior art attempts to solve the above problem, see for example, U.S. Pat. No. 4,862,210 to Woolley and U.S. Pat. No. 5,080,745 to Paull. The disclosures of both of these patents is hereby incorporated by reference.

SUMMARY OF THE INVENTION

One object of the present invention is to provide a refillable toner cartridge in which leakage of toner during filling and/or insertion and use is minimized.

This, and other, objects are accomplished by the refillable toner cartridge as presently disclosed, in which a magnetic strip is provided on at least one of the longer sides of the exit opening of the cartridge which has a cover temporarily in place. Since the toner is a magnetizable powder, the occasional leakage will be collected by the magnetic strips, effectively avoiding the problem of leakage.

DETAILED DESCRIPTION OF THE INVENTION

Figure 1:
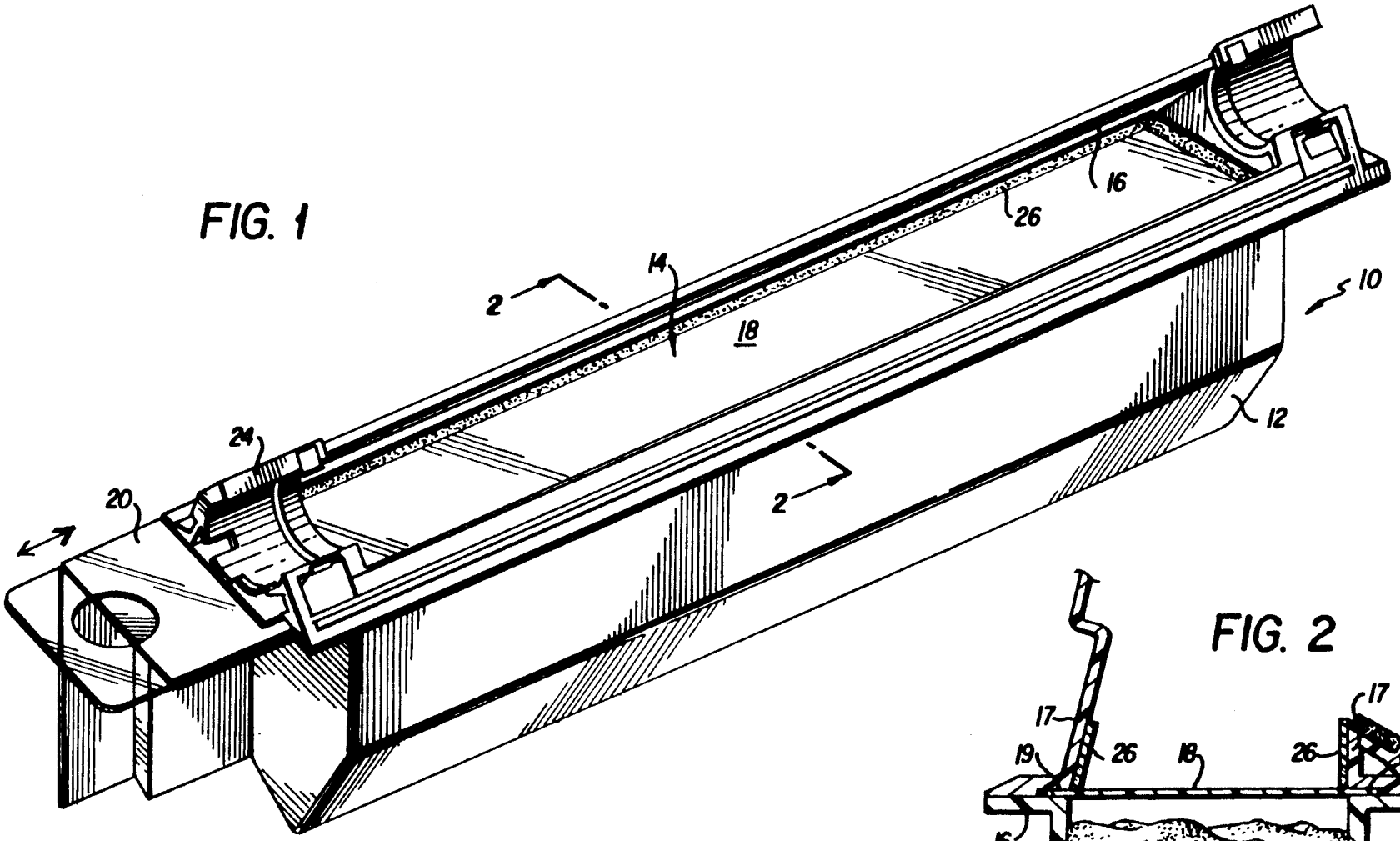
FIG. 1 is a perspective view of a refillable toner cartridge showing the magnetic strips of the present invention.

An example of a reusable toner cartridge to which the present invention may be applicable is shown in FIG. 1. It is contemplated that the present invention is equally applicable to other shapes and configurations of cartridges with other types of toner powder exit openings; the present drawing represents but one possible configuration. The reusable toner cartridge 10 of FIG. 1 has an elongated plastic body 12, which has a rectangular toner exit opening 14 along one side and a round filler opening (not shown) at one end. This round filler opening which is usually on the end of the rectangular elongated plastic body has a removable cap, which is removed to fill the body with toner, the refilling taking place after the exit opening has been covered.

Figure 2:
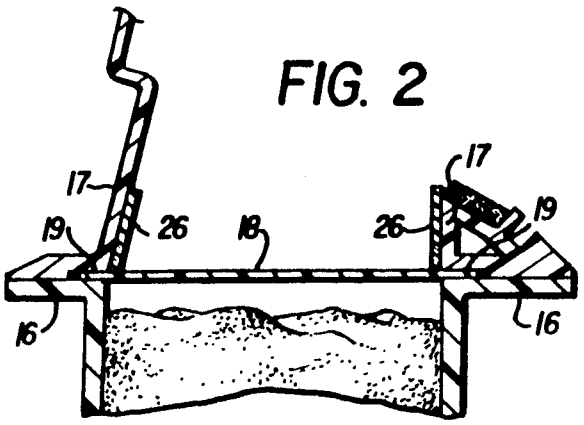
FIG. 2 is a side sectional view of the cartridge of the present invention filled with toner powder, taken along line 2—2 of FIG. 1.

The rectangular opening 14 has a grooved lip 16, which extends generally horizontally in FIG. 2, along at least the two longer sides thereof. The rectangular toner exit opening 14 of the plastic body 12 is covered prior to refilling and for shipment and handling thereafter, by an elongated removable cover 18, made of plastic or metal and which axially slides into a groove 19 between the lip 16 and a flange 17. The removable plastic or metal cover 18 is of a size and shape as to securely fit within the lip and is intended to sealing cover the rectangular opening 14. The removable cover 18 also has a gripping portion 20, for sliding of the cover, which protrudes off to one side of the rectangular opening 14 when the cover 18 is in place. The portion 20 has a round hole 22 in the middle to allow easier gripping thereof. The removable cover is preferably of a metal or a flexible plastics material similar to the material of the body. The reusable toner cartridge 10 also has a suitable means for engaging other parts of the copier such as a roller and securing the cartridge within a printer or copy machine, such a flange 24, which is of semicircular shape.

The exit opening 14 has about its periphery a flange 17 which is generally perpendicular to lip 16 and has a flat surface which is generally parallel to the flow of toner powder out of exit opening 14.

The present invention concerns a strip of magnetic material 26 which is secured to at least one of the flanges 17, and preferably on all sides, adjacent an edge of the rectangular opening 17 and is exterior of (downstream of) the cover 18. In a preferred embodiment, the strip is of a magnetic elastomeric product of at least 1 MGO such as a brand sold by Minnesota Mining and Manufacturing Co. (3M) under the trademark Plastiform 1316 and of a width of about ¼ inch. The strip is preferably adhesively secured to flange 17. However, the strip can be of any material which is of a suitable magnetic strength and which is attached as needed.

Additionally, the magnetic material can be any substance which will serve this purpose, such as a paint or a spray or the like.

As shown in FIG. 2, when the cartridge 10 is filled with toner powder 28, the removable plastic cover 18 covers the rectangular opening 14 of the cartridge 10 to prevent the toner 28 from leaking. However, when the cartridge 10 is moved, handled, dropped or subjected to vibration there is a distinct danger of toner powder leakage. In addition, when the cartridge is inverted ready to be inserted into a printer, not shown, the removable plastic cover 18, prior to its removal, must support the toner powder without leakage. The magnetic rubber strips 26 prevent the toner 28 from leaking past the opening 14 of the cartridge 10. Any toner which begins to leak will be attracted to the magnetic strip 26, and will remain adhered thereto until the toner cartridge is removed. In this manner, leakage both during insertion and use is avoided. As can be seen in FIG. 2, the strips 26 are placed in close proximity to the outer surface of cover 18 so as to minimize any leakage gap along grooved lip 16.

What is claimed:

1. A reusable cartridge for powdered magnetizable toner comprising;

an elongated container body which has a rectangular opening along one side; the rectangular opening having a groove along at least the longer sides thereof; an elongate removable rectangular cover which covers the opening of the container body by sliding into the groove; a flange on the container body exterior to the cover and groove; a strip of magnetic material on at least a major portion of said flange and being positioned to attract and hold any toner powder leaking past said cover, said strip of magnetic material being a magnetic energy product of at least 1 MGO.

2. The cartridge of claim 1, wherein the strip is of an elastomeric material adhesively secured to the flange.

* * * * *